US010413139B2

(12) United States Patent
Singer

(10) Patent No.: US 10,413,139 B2
(45) Date of Patent: Sep. 17, 2019

(54) DISPOSABLE PLUNGER COVER AND METHOD OF USE

(71) Applicant: Kevin Singer, Los Angeles, CA (US)

(72) Inventor: Kevin Singer, Los Angeles, CA (US)

( * ) Notice: Subject to any disclaimer, the term of this patent is extended or adjusted under 35 U.S.C. 154(b) by 113 days.

(21) Appl. No.: 15/428,876

(22) Filed: Feb. 9, 2017

(65) Prior Publication Data

US 2018/0220860 A1 Aug. 9, 2018

(51) Int. Cl.

| | |
|---|---|
| ***A45C 11/26*** | (2006.01) |
| ***A47K 17/00*** | (2006.01) |
| *E03D 9/00* | (2006.01) |
| *E03C 1/30* | (2006.01) |

(52) U.S. Cl.
CPC ..... *A47K 17/00* (2013.01); *E03C 1/30* (2013.01); *E03D 9/00* (2013.01)

(58) Field of Classification Search
CPC ..... A47K 17/00; B65D 85/70; E03D 9/00; A45C 11/26
USPC ..... 206/349, 361
See application file for complete search history.

(56) References Cited

U.S. PATENT DOCUMENTS 10,053,846 B1 * 8/2018 Rim ..... E03C 1/308
2002/0152547 A1 * 10/2002 Pardo ..... E03D 9/00 4/300.3
2003/0216611 A1 * 11/2003 Q. Vu ..... A61B 17/00234 600/37
2009/0049593 A1 * 2/2009 Hodkiewicz ..... E03C 1/308 4/255.05
2011/0010832 A1 * 1/2011 Tsiros ..... E03D 9/00 4/255.11

FOREIGN PATENT DOCUMENTS

WO WO 2018013149 A1 * 1/2018 ..... A47K 11/00

* cited by examiner

*Primary Examiner* — Rafael A Ortiz
(74) *Attorney, Agent, or Firm* — Parsons & Goltry; Robert A. Parsons; Michael W. Goltry

(57) ABSTRACT

A disposable toilet plunger cover assembly designed to be used with a standard toilet plunger. The assembly including a connection receiver designed to be attached to a standard toilet plunger at a central area of the inner surface of the toilet plunger head and an elongated flexible plastic bag having a lower enclosed end and an upper open end. The bag having an interior volume sufficient to enclose the head of the standard toilet plunger and a portion of the handle. A ring-shaped sealing gasket attached to the outer surface of the bag at the lower enclosed end, the ring shaped gasket formed to concentrically mate with the ring-shaped lower edge of the toilet plunger, and a connector attached to the inner surface of the bag at an area centrally located within the sealing gasket. The connector is constructed to be removably attached to the connection receiver.

9 Claims, 6 Drawing Sheets

DISPOSABLE PLUNGER COVER AND METHOD OF USE

FIELD OF THE INVENTION

This invention relates to toilet plungers and more specifically to disposable covers for reducing cleaning efforts.

BACKGROUND OF THE INVENTION

Toilet plungers are used in conjunction with toilets to remove clogs that prevent toilets from operating properly. It is understood that such plungers may also be used to unclog sinks and the like, all of which is intended to be included in this disclosure and to come within the concept of a clogged toilet. Therefore, the term "toilet plunger" is intended to include all plungers that are or may be used to unclog drains of any sort. As is known by anyone with a flushable toilet, clogs occur that prevent water and waste, such as dreck, from flowing down the connecting disposal pipes. Generally, the flexible head of the plunger is placed in the toilet over the outlet in the bottom. The plunger is forcibly moved down and released, creating a vacuum in the outlet which loosens the clog allowing the free flow of the waste material through the outlet.

As is immediately obvious, this procedure results in a very dirty plunger which must then be rinsed off or washed to remove all waste from the surfaces of the flexible head and lower portion of the handle. This washing or cleaning process can be very messy and for people without a back yard and hose can then result in a very messy sink or other structure in which the plunger is washed.

It would be highly advantageous, therefore, to remedy the foregoing and other deficiencies inherent in the prior art.

Accordingly, it is an object of the present invention to provide a new and improved disposable cover for toilet plungers and methods of use.

It is another object of the present invention to provide a new and improved disposable cover for toilet plungers that does not reduce the operation or effectiveness of toilet plungers and reduces the effort required for cleaning the plunger after use.

It is another object of the present invention to provide a new and improved disposable cover for toilet plungers that is easy to use and relatively inexpensive.

SUMMARY OF THE INVENTION

Briefly to achieve the desired objects and advantages of the instant invention in accordance with a preferred embodiment a disposable toilet plunger cover assembly is disclosed. The assembly is designed to be used with a standard toilet plunger and includes a connection receiver designed to be attached to the standard toilet plunger at a central area of the inner surface of the toilet plunger head and an elongated flexible plastic bag having a lower enclosed end and an upper open end. The bag has an interior volume sufficient to enclose the head of the standard toilet plunger and a portion of the handle. A ring-shaped sealing gasket is attached to the outer surface of the bag at the lower enclosed end. The ring shaped gasket is formed to concentrically mate with the ring-shaped lower edge of the toilet plunger, and a connector is attached to the inner surface of the bag at an area centrally located within the sealing gasket. The connector is constructed to be removably attached to the connection receiver.

To further achieve the desired objects and advantages of the present invention a method of forming a disposable toilet plunger cover assembly designed to be used with a standard toilet plunger is disclosed. The standard toilet plunger has an elongated handle and a generally hemispherical head attached to one end of the handle, the hemispherical head has an inner surface and an outer surface with the head terminating in a ring-shaped lower edge. The method includes the step of providing a connection receiver designed to be attached to the standard toilet plunger. The connection receiver is designed to be attached to a central area of the inner surface of the toilet plunger head. The method further includes the steps of providing an elongated flexible plastic bag having an inner surface and an outer surface formed into a lower enclosed end and an upper open end, the bag having an interior volume sufficient to enclose the head of the standard toilet plunger and a portion of the handle; providing a ring-shaped sealing gasket and attaching the gasket to the outer surface of the bag at the lower enclosed end, the ring shaped gasket being formed to concentrically mate with the ring-shaped lower edge of the toilet plunger; and providing a connector and attaching the connector to the inner surface of the bag at an area centrally located within the sealing gasket, the connector being constructed to be removably attached to the connection receiver.

To further achieve the desired objects and advantages of the present invention a method of using a disposable toilet plunger cover assembly with a standard toilet plunger is disclosed. The standard toilet plunger has an elongated handle and a generally hemispherical head attached to one end of the handle, the hemispherical head having an inner surface and an outer surface, the head terminating in a ring-shaped lower edge. The method includes the step of providing a disposable toilet plunger cover assembly including a connection receiver and an elongated flexible plastic bag having a ring-shaped sealing gasket attached to an outer surface of the bag at a lower enclosed end and a connector attached to an inner surface of the bag at an area centrally located within the sealing gasket. The method further includes the steps of attaching the connection receiver to the standard toilet plunger at a central area of the inner surface of the toilet plunger head; enclosing the head of the standard toilet plunger and a portion of the handle in the elongated flexible plastic bag, the ring shaped gasket being positioned concentrically with the ring-shaped lower edge of the toilet plunger; removably attaching the connector to the connection receiver in the head of the toilet plunger; affixing a binder around the open end of the plastic bag and the handle of the toilet plunger so as to secure the bag to the handle of the plunger with the plunger head and a portion of the handle enclosed within the bag; operating the enclosed toilet plunger in a normal manner to remove the clog, obstruction or impediment; and removing the binder, turning the bag inside-out, detaching the connector and the connection receiver, and disposing of the inverted bag.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION OF THE DRAWINGS

Figure 1:
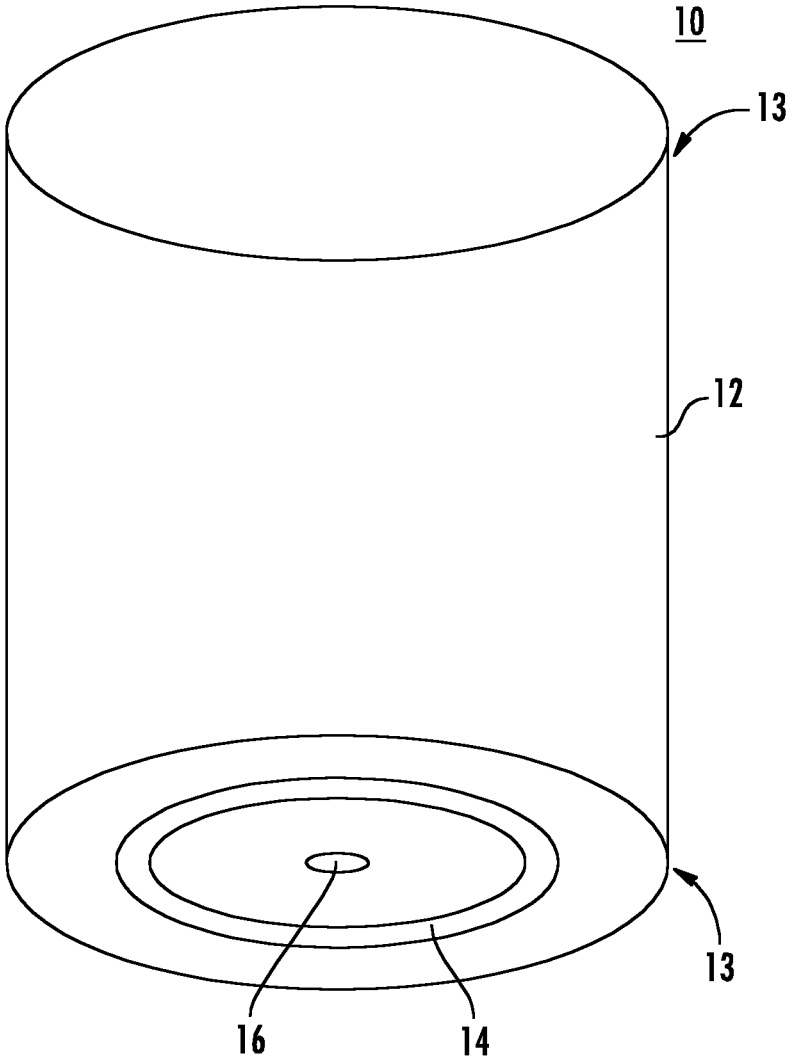
FIG. 1 is a schematic perspective view of a disposable toilet plunger cover according to the present invention.
Figure 2:
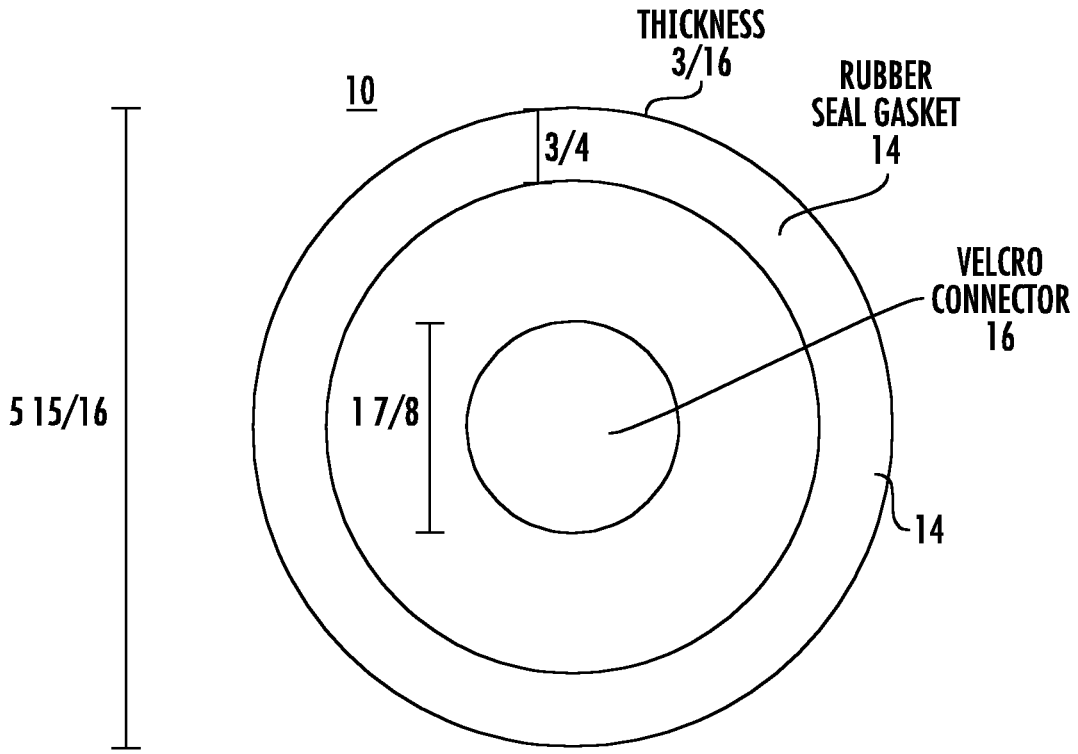
FIG. 2 is a schematic bottom view of the disposable toilet plunger cover of FIG. 1.

Turning now to the drawings in which like reference characters indicate corresponding elements throughout the several views, attention is directed to FIGS. 1 and 2 which illustrate a disposable toilet plunger cover 10 according to the present invention. Disposable toilet plunger cover 10 includes a flexible plastic bag 12 having an inner surface and an outer surface and a lower enclosed end 11 and an upper open end 13. Flexible plastic bag 12 has an interior volume sufficient to enclose the head of a standard toilet plunger and a portion of the handle. Bag 12 has a pliable sealing gasket 14 fixedly attached to the outer surface of lower end 11 of bag 12. A Velcro connector 16 is fixedly attached to the inner surface of bag 12 approximately in the center of sealing gasket 14.

Bag 12 is illustrated as a thin, plastic material that is preferably clear or transparent to simplify the operation of the plunger and cover. The material could be, for example, similar in thickness to flexible material used commercially for temporarily enclosing food. It should be understood, however, that clear or transparent is not necessary. Other thin, flexible plastics, such as commercially available leaf and garbage bags, may be used if desired or less expensive.

Also, in a preferred embodiment, pliable sealing gasket 14 is formed of rubber that has a soft enough texture to form a reasonable seal between the bottom surfaces of a plunger and the surface of a toilet. It will be understood however that some plastic materials are available that can adequately perform the sealing task. In the preferred embodiment illustrated in FIGS. 1 and 2, pliable sealing gasket 14 has an outer diameter of five and fifteen sixteenths inches and is three sixteenths inch thick with a three quarter inch surface between the outer diameter and the inner diameter to provide sufficient sealing between the plunger and the toilet. Velcro connector 16 is preferably disk shaped with a one and seven eighths inch outer diameter. It will be understood that these specific shapes and sizes are preferred for use with a generic plunger but other shapes and sizes might be used in specific instances or with slightly different plungers.

Figure 3:
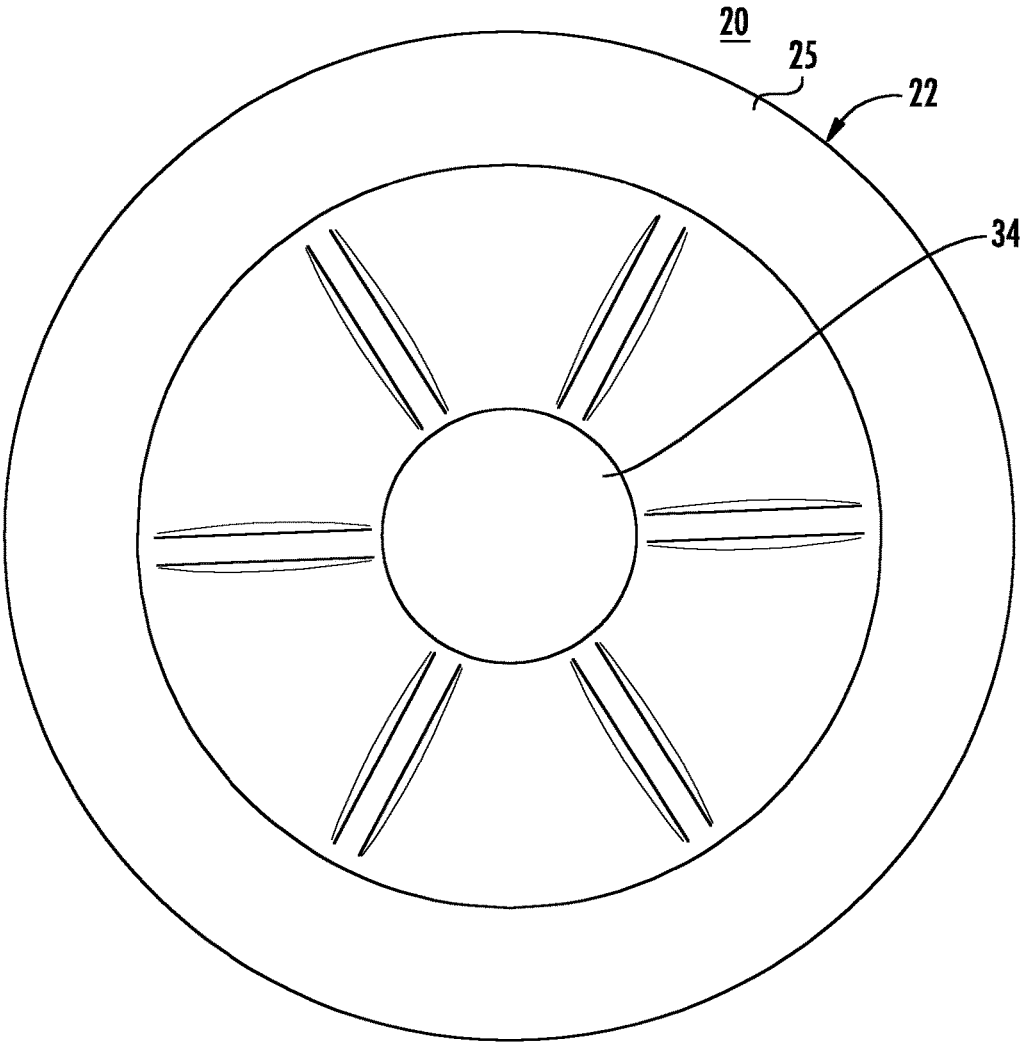
FIG. 3 is a bottom view of a modified toilet plunger according to the present invention.

Turning now to FIG. 3, a modified toilet plunger 20, according to the present invention, is illustrated. Toilet plunger 20 includes an elongated handle 21 and a flexible head 22 attached to one end of handle 21. As is well-known in the art, flexible head 22 is generally formed of rubber or other stiff but flexible material. Further, flexible head 22 is generally hemispherically shaped with an inner surface, illustrated in FIG. 3, and an outer surface. The inner and outer surfaces terminating in a lower ring-shaped flat edge 23 designed to be pressed against and form a seal with the inner surface of a toilet bowl around the exit pipe. Plunger 20 is modified by fixedly engaging a connection receiver 24 in the center of the inside surface of head 22. Connection receiver 24 is designed to mate with connector 16 in bag 12 and removably hold the portion of bag 12 within gasket 14 loosely but firmly within head 22 of plunger 20. In this preferred embodiment, connection receiver 24 is a Velcro disk, designated 24 in FIG. 3, formed to removably attach or mate with Velcro connector 16 attached to the inner surface of bag 12. It should be noted that since connection receiver 24 is protected from waste fluid by bag 12, it can be permanently installed and does not require changing or cleaning.

Figure 4:
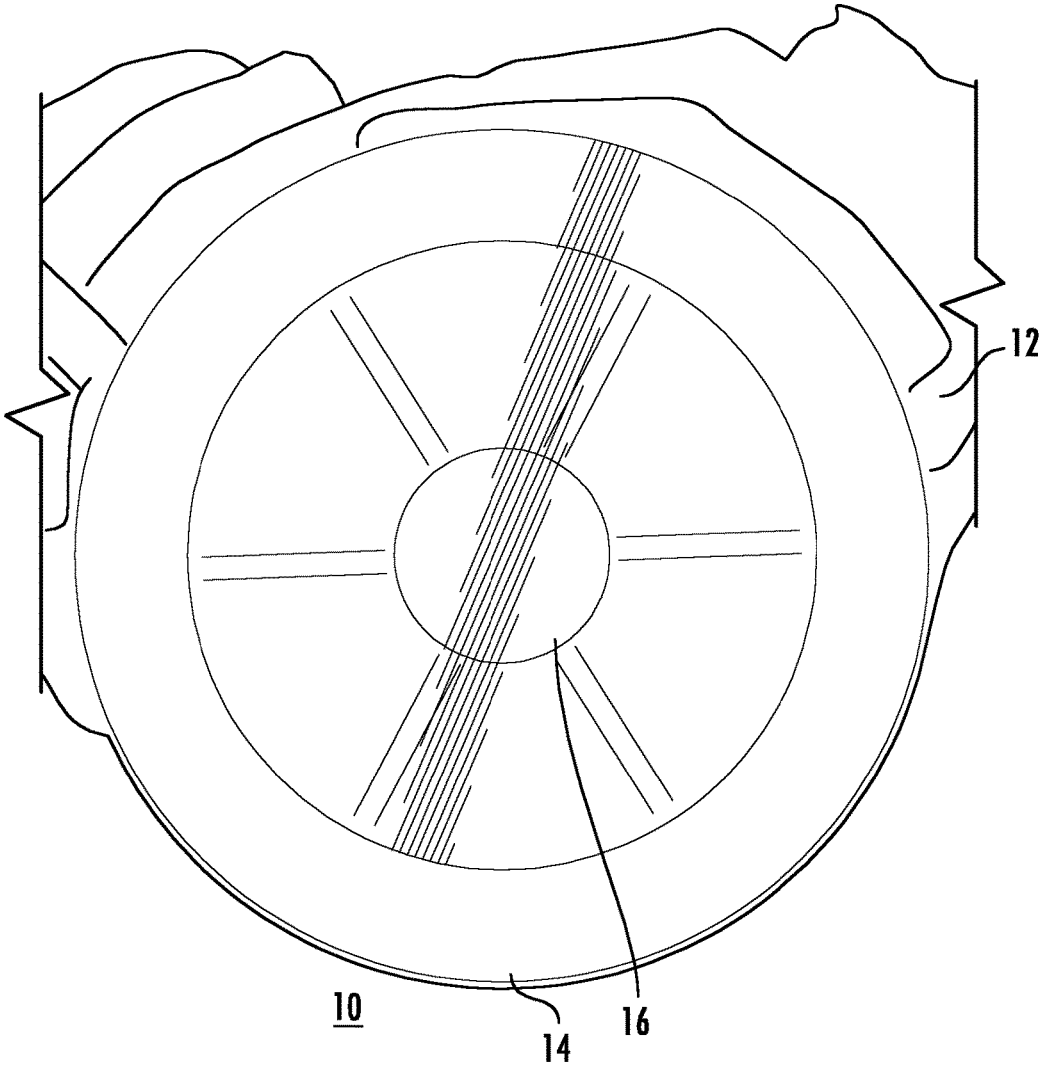
FIG. 4 is a perspective bottom view of an actual disposable toilet plunger cover as depicted in FIGS. 1 and 2.

Referring additionally to FIG. 4, an actual disposable toilet plunger cover 10, in accordance with the present invention, is illustrated. It can be seen from this illustration that bag 12 is sufficiently large to receive flexible head 22 of plunger 20 therein and is sufficiently flexible to cover the inner and outer surfaces of flexible head 22 of plunger 20.

Figure 5:
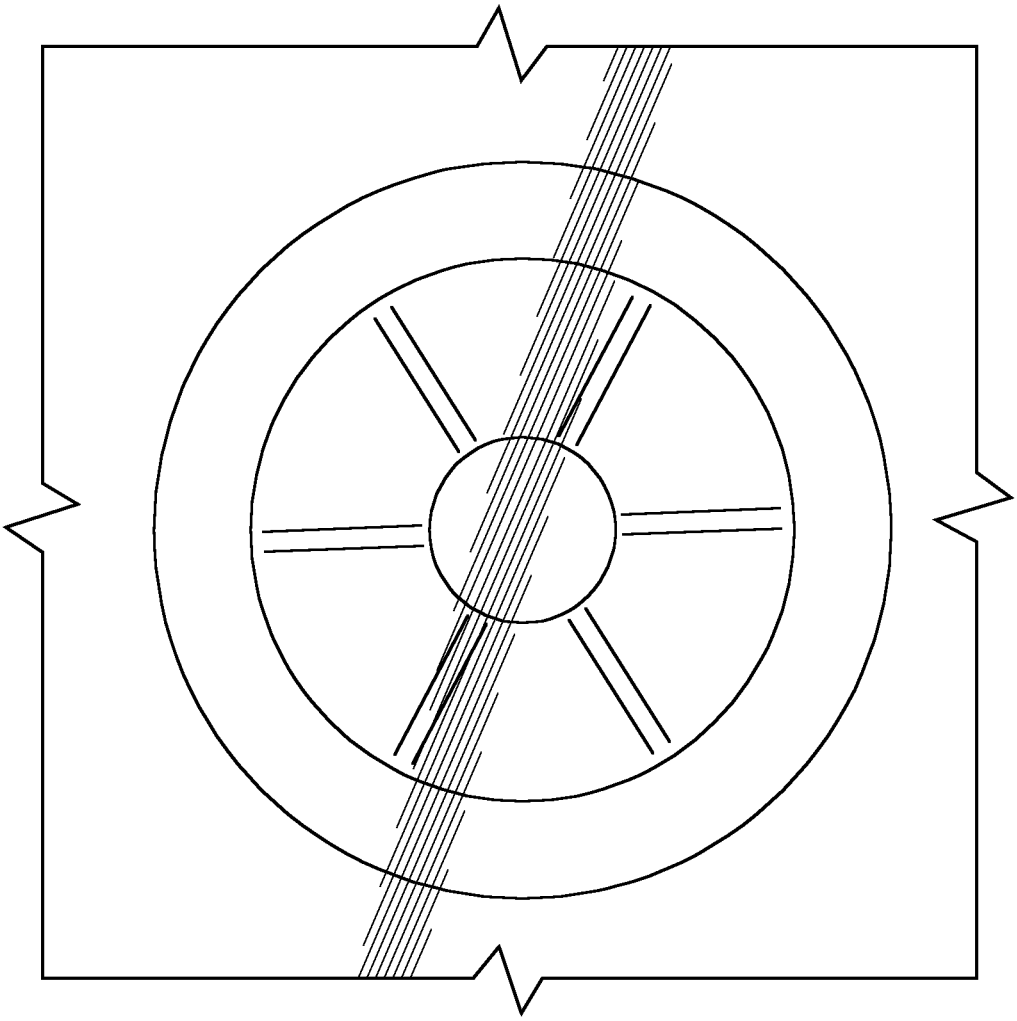
FIG. 5 is a bottom view illustrating the disposable toilet plunger cover of FIG. 4 installed on the modified toilet plunger of FIG. 3 according to the present invention.
Figure 6:
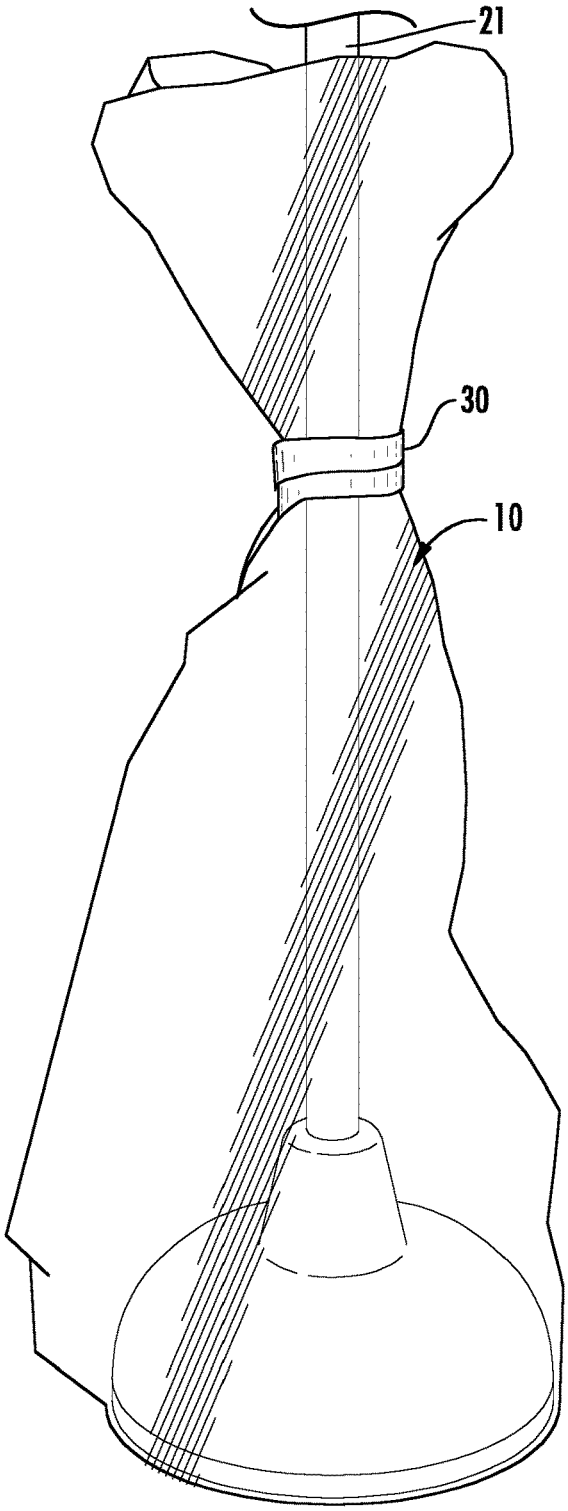
FIG. 6 is a perspective side view of the disposable toilet plunger cover installed on the modified toilet plunger of FIG. 5.

Referring additionally to FIGS. 5 and 6, plunger 20 is illustrated within bag 12 and extending partially up handle 21 where bag 12 is held in place with a binder 30. Binder 30 may be, for example a simple wire twisted around bag 12 and handle 21, a resilient band (e.g. a rubber band), or some sort of tie (e.g. string, rope, etc.). In the preferred embodiment a resilient band designed specifically for the purpose may be provided with multiple bags 12 as an over-the-counter product. Bag 12 is sufficiently large or deep to cover plunger head 22 and to extend sufficiently far up handle 21 so as to be well above the fluid surface in a toilet when operating plunger 20 in a normal fashion.

While connector 16 in the interior of bag 12 and connection receiver 24 affixed to the inner surface of plunger 20 are described as Velcro components in the preferred embodiment, it will be understood that other types of fasteners might be used in special circumstances. For example, a simple metal or plastic snap and retainer (i.e. used in many clothing items) might be substituted. However, Velcro matching components are preferred because of the simplicity of attachment and use and because they can be formed very inexpensively. In this preferred embodiment, Velcro matching components are fixedly attached by using some adhesive, such as glue, epoxy, etc. Also, gasket 14 is fixedly attached to bag 12 by some convenient means such as adhesive, heat sealing, etc.

The operation or method of use of plunger 20 and cover 10 is as follows. Initially, plunger 20 is modified by fixedly attaching connection receiver, in this preferred embodiment, disk 24 in the center of the inner surface, as illustrated in FIG. 3. Plunger 20 is then inserted inside of bag 12. Connector 16 is then pushed into the interior of plunger head 22 and removably attached to disk 24 in the interior of plunger head 22. Since connector 16 is fixedly attached to the inner surface of bag 12 it can be engaged with disk 24 by simply pushing them together. With connector 16 removably attached to disk 24 gasket 14 is approximately concentric with and adjacent lower surface 23 of plunger head 22. Since gasket 14 is affixed to the outer surface of bag 12, a single layer of bag 12 will be sandwiched between gasket 14 and lower surface 23 of plunger head 22. However, since bag 12 is formed of thin plastic, a fluid seal will be formed between lower surface 23 of plunger head 22, gasket 14 and the surface of a toilet being operated on. The upper end of bag 12 is then bunched around plunger handle 21 and bag 12 is held in place with binder 30.

Plunger 20 is now ready for use in clearing obstructions from a toilet. Once the obstruction is cleared and the toilet is again operating properly, binder 30 can be removed and bag 12 turned inside out as it is removed from plunger 20. Thus, the messy outer surface of bag 12 is now completely contained within bag 12 and the inner surface, which is completely clean, now encloses the prior outer surface and can be simply disposed of in the garbage. Plunger 20 is clean, since it never came in contact with any of the fluids in the toilet, and can simply be placed back in its normal storage location.

Thus, a new and improved disposable cover for toilet plungers is disclosed. Also, a new and improved method of using the disposable cover for toilet plungers is disclosed. The new and improved disposable cover for toilet plungers does not reduce the operation or effectiveness of toilet plungers and greatly reduces the effort required for cleaning the plunger after use. Further, the new and improved disposable cover for toilet plungers is easier to use and relatively inexpensive.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A disposable toilet plunger cover assembly designed to be used with a standard toilet plunger, the standard toilet plunger having an elongated handle and a generally hemispherical head attached to one end of the handle, the hemispherical head having an inner surface and an outer surface, the head terminating in a ring-shaped lower edge, the assembly comprising:

a connection receiver designed to be attached to the standard toilet plunger, the connection receiver being designed to be attached to a central area of the inner surface of the toilet plunger head;

an elongated flexible plastic bag having an inner surface and an outer surface formed into a lower enclosed end and an upper open end, the bag having an interior volume sufficient to enclose the head of the standard toilet plunger and a portion of the handle;

a ring-shaped sealing gasket attached to the outer surface of the bag at the lower enclosed end, the ring shaped gasket formed to concentrically mate with the ring-shaped lower edge of the toilet plunger; and a connector attached to the inner surface of the bag at an area centrally located within the sealing gasket, the connector being constructed to be removably attached to the connection receiver.

2. The disposable toilet plunger cover assembly as claimed in claim 1 further including a binder constructed to extend around the open end of the plastic bag and secure the bag to the handle of the plunger with the plunger head and a portion of the handle enclosed within the bag.

3. The disposable toilet plunger cover assembly as claimed in claim 1 wherein the connection receiver and the connector are mating hook and loop fastener components.

4. The disposable toilet plunger cover assembly as claimed in claim 1 wherein the ring-shaped sealing gasket is formed of rubber.

5. A method of forming a disposable toilet plunger cover assembly designed to be used with a standard toilet plunger, the standard toilet plunger having an elongated handle and a generally hemispherical head attached to one end of the handle, the hemispherical head having an inner surface and an outer surface, the head terminating in a ring-shaped lower edge, the method comprising the steps of:

providing a connection receiver designed to be attached to the standard toilet plunger, the connection receiver being designed to be attached to a central area of the inner surface of the toilet plunger head;

providing an elongated flexible plastic bag having an inner surface and an outer surface formed into a lower enclosed end and an upper open end, the bag having an interior volume sufficient to enclose the head of the standard toilet plunger and a portion of the handle;

providing a ring-shaped sealing gasket and attaching the gasket to the outer surface of the bag at the lower enclosed end, the ring shaped gasket being formed to concentrically mate with the ring-shaped lower edge of the toilet plunger; and providing a connector and attaching the connector to the inner surface of the bag at an area centrally located within the sealing gasket, the connector being constructed to be removably attached to the connection receiver.

6. The method as claimed in claim 5 further including a step of providing a binder constructed to extend around the open end of the plastic bag and secure the bag to the handle of the plunger with the plunger head and a portion of the handle enclosed within the bag.

7. The method as claimed in claim 5 wherein the connection receiver and the connector are mating hook and loop fastener components.

8. The disposable toilet plunger cover assembly as claimed in claim 5 wherein the ring-shaped sealing gasket is formed of rubber.

9. A method of using a disposable toilet plunger cover assembly with a standard toilet plunger, the standard toilet plunger having an elongated handle and a generally hemispherical head attached to one end of the handle, the hemispherical head having an inner surface and an outer surface, the head terminating in a ring-shaped lower edge, the method comprising the steps of:

providing a disposable toilet plunger cover assembly including a connection receiver and an elongated flexible plastic bag having a ring-shaped sealing gasket attached to an outer surface of the bag at a lower enclosed end and a connector attached to an inner surface of the bag at an area centrally located within the sealing gasket;

attaching the connection receiver to the standard toilet plunger at a central area of the inner surface of the toilet plunger head;

enclosing the head of the standard toilet plunger and a portion of the handle in the elongated flexible plastic bag, the ring shaped gasket being positioned concentrically with the ring-shaped lower edge of the toilet plunger;

removably attaching the connector to the connection receiver in the head of the toilet plunger;

affixing a binder around the open end of the plastic bag and the handle of the toilet plunger so as to secure the bag to the handle of the plunger with the plunger head and a portion of the handle enclosed within the bag;

operating the enclosed toilet plunger in a normal manner to remove the clog, obstruction or impediment; and removing the binder, turning the bag inside-out, detaching the connector and the connection receiver, and disposing of the inverted bag.

* * * * *